United States Patent [19]

Tice

[11] 4,271,775

[45] Jun. 9, 1981

[54] NEEDLE POSITIONER FOR HIGH SPEED STITCHING MACHINES

[75] Inventor: William A. Tice, Knoxville, Tenn.

[73] Assignee: Tice Engineering & Sales, Inc., Knoxville, Tenn.

[21] Appl. No.: 67,702

[22] Filed: Aug. 17, 1979

[51] Int. Cl.[3] ..... D05B 69/22

[52] U.S. Cl. ..... 112/276

[58] Field of Search ..... 112/220, 221, 67, 87, 112/276, 301, 274, DIG. 3

[56] References Cited

U.S. PATENT DOCUMENTS 3,541,982 11/1970 Marforio .

3,924,553 12/1975 Tice .

3,977,339 8/1976 Tice .

*Primary Examiner*—Werner H. Schroeder

*Assistant Examiner*—Andrew M. Falik

[57] ABSTRACT

A system for positioning the needle of a high speed stitching machine includes a pitman assembly connected to a foot pedal and extending upwardly therefrom. A piston-cylinder device is interposed between the pitman assembly and a brake actuating mechanism for a main drive motor. A valve is secured to the pitman assembly in proximity to a stationary member. The valve is connected in fluid communication with the piston-cylinder device and a needle positioning mechanism.

4 Claims, 3 Drawing Figures

NEEDLE POSITIONER FOR HIGH SPEED STITCHING MACHINES

This invention relates to systems for positioning the reciprocatory needle of a stitching machine in a predetermined position along its reciprocatory path.

In U.S. Pat. Nos. 3,924,553 and 3,977,339, the present inventor disclosed and claimed a needle positioning apparatus for stitching machines wherein a pneumatically driven motor was connected to the shaft which provides reciprocatory motion to the needle. These two patents are incorporated herein by reference. In the apparatus disclosed in such patents, there was included in the stitching machine an overriding clutch which in effect selectively isolated the needle driving shaft from the main drive motor employed to rotate such needle driving shaft. By this means, the needle driving shaft was also selectively isolated from the braking function of the stitching machine. Such braking function is normally incorporated in a brake-clutch assembly associated with the main drive motor for the stitching machine.

In certain stitching machines, particularly those in which the needle is reciprocated at a rate of 4,000 stitches per minute or faster, and/or in those machines wherein the stitching mechanism is relatively massive or is moving at a relatively high speed so that it possesses significant inertia (herein termed "high-speed" stitching machines), it is undesirable to use an overriding clutch mechanism connected to the needle driving shaft as a means for isolating the motor (with its braking mechanism) from the needle drive shaft. But rather, in such machines, it is desired that the motor with its braking mechanism remain in driving engagement with the needle reciprocating shaft to positively stop the rotation of the needle reciprocating shaft, hence stitching motion of the needle, when the operator operates the foot pedal to effect disengagement of the main drive motor from the stitching mechanism.

In needle positioning systems for high speed stitching machines, there is the further problem of how to utilize the ordinary operator motions of starting and stopping stitching operations to control the needle positioning function in coordination with such start and stop functions. In high speed stitching machines, once the operator releases a foot pedal control, the drive mechanism for the stitching machine moves to an immediate "full stop" position by reason of the design of the mechanism and is biased to remain in this "full stop" position until the start of a further stitching operation thereby preventing the "free" rotation of the needle driving shaft that is required for repositioning the needle after the stopping of a stitching operation. This design has heretofore severely inhibited the development of a needle positioning system for such machines.

It is therefore an object of the present invention to provide an improved apparatus for positioning the needle of those stitching machines wherein it is desired that the needle reciprocating mechanism be positively stopped upon disengagement of the main drive motor from the stitching mechanism. It is another object of this invention to provide a pneumatically powered needle positioning apparatus for high speed stitching machines.

Other objects and advantages of the invention will be apparent from the following description, including the claims and drawings in which:

Figure 1:
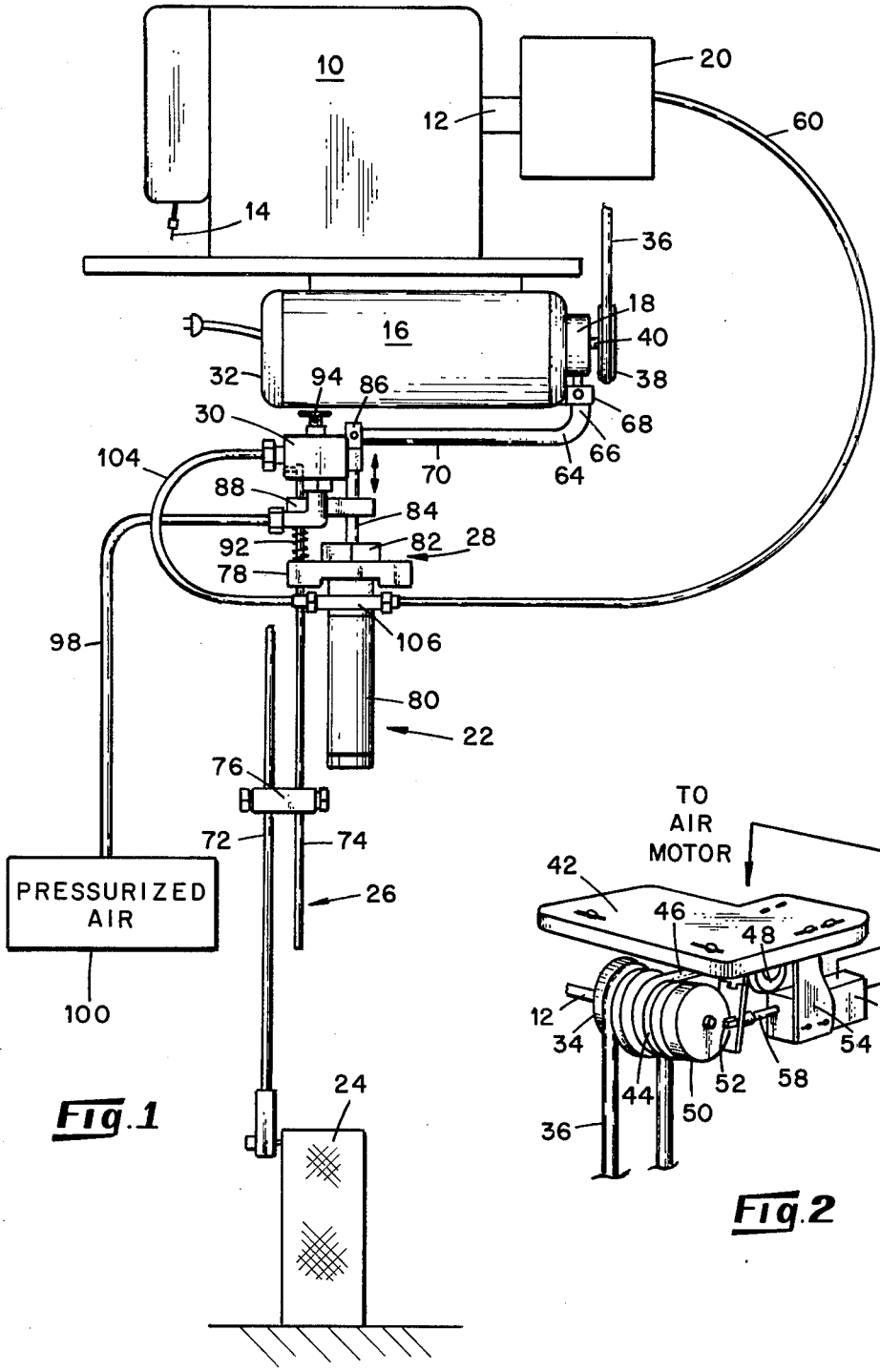
FIG. 1 is a representation of a needle positioning system embodying various features of the invention.

In accordance with the present invention, there is provided, in combination, a foot pedal-controlled stitching machine 10 including a shaft means 12 connected to a stitching needle 14 for reciprocatory movement of such needle and being drivingly connected in a positive matter to a main drive motor 16 having a braking mechanism 18 associated therewith, a pneumatically powered needle positioning mechanism 20, and a control system 22 interposed between the foot pedal 24 and the main drive motor and the needle positioning mechanism. This control system includes a pitman assembly 26 connected to the foot pedal and extending upwardly therefrom, a pneumatically powered piston-cylinder device 28 interposed between the pitman assembly and the brake actuating mechanism for the main drive motor, and valve means 30 secured to the pitman assembly in proximity to a stationary member, for example, the motor housing 32 of the main drive motor, a structural member or the like, and means connecting the valve means in fluid communication with the piston-cylinder device and the needle positioning mechanism. As disclosed, the inventor has found that by means of a piston-cylinder device which is positionable in coordination with the foot pedal of the stitching machine and whose piston member is connected to the brake actuating means for preselectable limited movement thereof after the stopping of a stitching operation, the needle positioning operation can be accomplished without interdiction of further operator effort.

More specifically, referring to FIG. 1, there is depicted a stitching machine 10 of a conventional type, for example, a Model 281 from the Singer Manufacturing Company stitching machine. This machine, and other "high speed" stitching machines, include a shaft 12 which is connected by conventional means (not shown) to a stitching needle 14 which is mounted for movement along a reciprocatory path. The shaft 12 is provided with a first pulley 34 about which there is entrained a drive belt 36 which further engages a pulley 38 mounted on the output shaft 40 of a main drive motor 16. Commonly, the drive motor 16 is of the electric type. This drive system is adapted to rotate the shaft 12 at a speed which reciprocates the stitching needle at a rate of up to 8,000–10,000 stitches per minute. These so-called "high speed" stitching machines commonly include mechanism which is sufficiently massive such that when the main drive motor is deactivated, unless a braking action is applied to the shaft 12, the inertia of the machine mechanism will result in one or more reciprocations of the stitching needle after such deactivation of the main drive motor. In many stitching operations, such additional stitching is undesired. Accordingly, the pulley 34 is rigidly mounted to the shaft 12, and the main drive motor is provided with a braking mechanism 18 such that deactivation of the main drive motor is immediately followed by a braking thereof which in turn is transmitted through the pulley 38, the drive belt 36, and the pulley 34 to the shaft 12, thereby effecting immediate cessation of needle reciprocation upon deactivation of the main drive motor.

Figure 2:
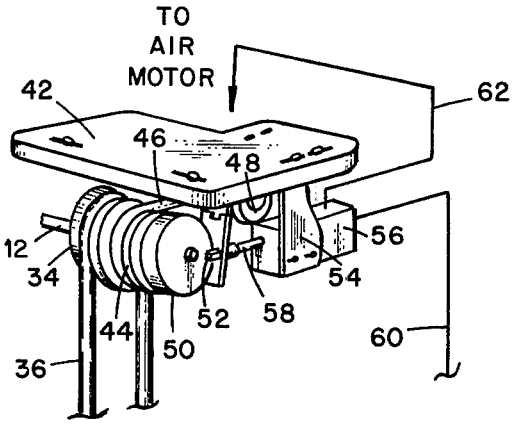
FIG. 2 is a representation of a pneumatically powered needle positioning mechanism.

The pneumatic needle positioning mechanism 20 depicted in FIG. 2 is essentially identical to the mechanism described and claimed in U.S. Pat. No. 3,977,339, issued to the present inventor. This mechanism includes a plate-type bracket 42 adapted to be mounted to the housing of the stitching machine 10, and serving as the mounting for various elements of the positioning mechanism. Specifically, the shaft 12 of the stitching machine has mounted on the outboard end thereof a pulley 44 which is drivingly connected by means of a belt 46 to an air motor 48. Further, the shaft 12 is provided with a cam 50 fixedly secured thereto, such cam including a recess 52 on its circumferential periphery.

Depending from the mounting plate 42 is a bracket member 54 to which there is affixed a piston-cylinder control device 56, the piston member 58 of which extends therefrom to engage the cam 50. Actuation of this needle positioning mechanism is by means of pressurized air supplied to the piston-cylinder device 56 by way of a conduit 60. The piston-cylinder device 56 is further connected by a conduit 62 to the air motor 48. For a further description of this apparatus, including its functioning, reference is made to applicant's U.S. Pat. No. 3,977,339.

Referring again to FIG. 1, the main drive motor 16 of the stitching machine is provided with a brake-clutch mechanism indicated generally by the numeral 18. This brake-clutch mechanism includes an arm 64 of generally L-shape, one leg 66 of which is pivotally connected by a bracket 68 to the housing 32 of the main drive motor 16. This leg serves to activate and/or deactivate the clutch mechanism and/or braking mechanism, depending upon the type of mechanism provided. In certain stitching machines, the main drive motor runs continuously so that there is provided a clutch mechanism for engaging and disengaging the shaft of the motor 16 as desired. In this type stitching machine arrangement, the arm 64 serves to engage and/or disengage the clutch as well as serving to activate the brake mechanism. In the depicted embodiment, upward movement (as viewed in FIG. 1) of the further leg 70 of the arm 64 serves to disengage the clutch mechanism and to activate the braking mechanism for the main drive motor. Conversely, downward movement of the leg 70 serves to release the brake and engage the clutch mechanism to commence a stitching operation.

In accordance with the depicted embodiment of the present invention, there is pivotally connected to the foot pedal 24 a first pitman rod 72 which is releasably connected in rigid relationship to a second pitman rod 74 as by means of a coupling 76. The coupling 76 provides for lineal adjustment of the pitman rods 72 and 74 relative to one another for selecting the effective length thereof. If desired, a single pitman rod may be substituted for these two rods, but at the sacrifice of ready adjustability. The upper outboard end of the pitman rod 74 has affixed thereto a first bracket 78 which extends therefrom at a generally right angle to receive a piston-cylinder device indicated generally by the numeral 28.

This bracket 78 is provided with an opening through which the cylinder 80 of the piston-cylinder device is fitted, the cylinder 80 being secured in the opening as by a cap nut 82 or by other means such as by spot welding. The piston member 83 of the piston-cylinder device 28 includes a piston rod 84, which projects from the cylinder 80 upwardly and is pivotally connected at its outboard end as by a yoke 86 to the outboard end of the leg 70 of the arm 64 such that retraction of the piston rod 84 within the cylinder 80 results in downward movement of the leg 70 and, conversely, extension of the piston rod 84 from the cylinder 80 results in upward movement of the leg 70. The piston rod 84 has adjustably secured thereto as by means of a set screw 87, a guide bracket 88 which extends laterally therefrom and defines an opening through which there is slidably received the pitman rod 74 such that the piston rod 84 is guided in its reciprocatory movements. Coil spring means 92 is provided on the pitman rod 74 to aid in the sliding movement of the guide bracket 88 along such rod. It is to be noted that the location of the guide bracket 88 along the length of the piston rod 84 is selectable and that when the piston rod is retracted into the cylinder 80, the guide bracket can be made to contact the nut 82 and thereby limit the retraction of the piston rod to the extent desired. This adjustment feature permits field selection of the degree of movement imparted to the leg 70 of the arm 64 to bring about the desired limitation of the movement of the arm 64 to that which releases the brake mechanism to permit free movement of the stitching mechanism without moving the arm 64 to the extent that the drive motor 16 is reactivated to drive the stitching mechanism.

Figure 3:
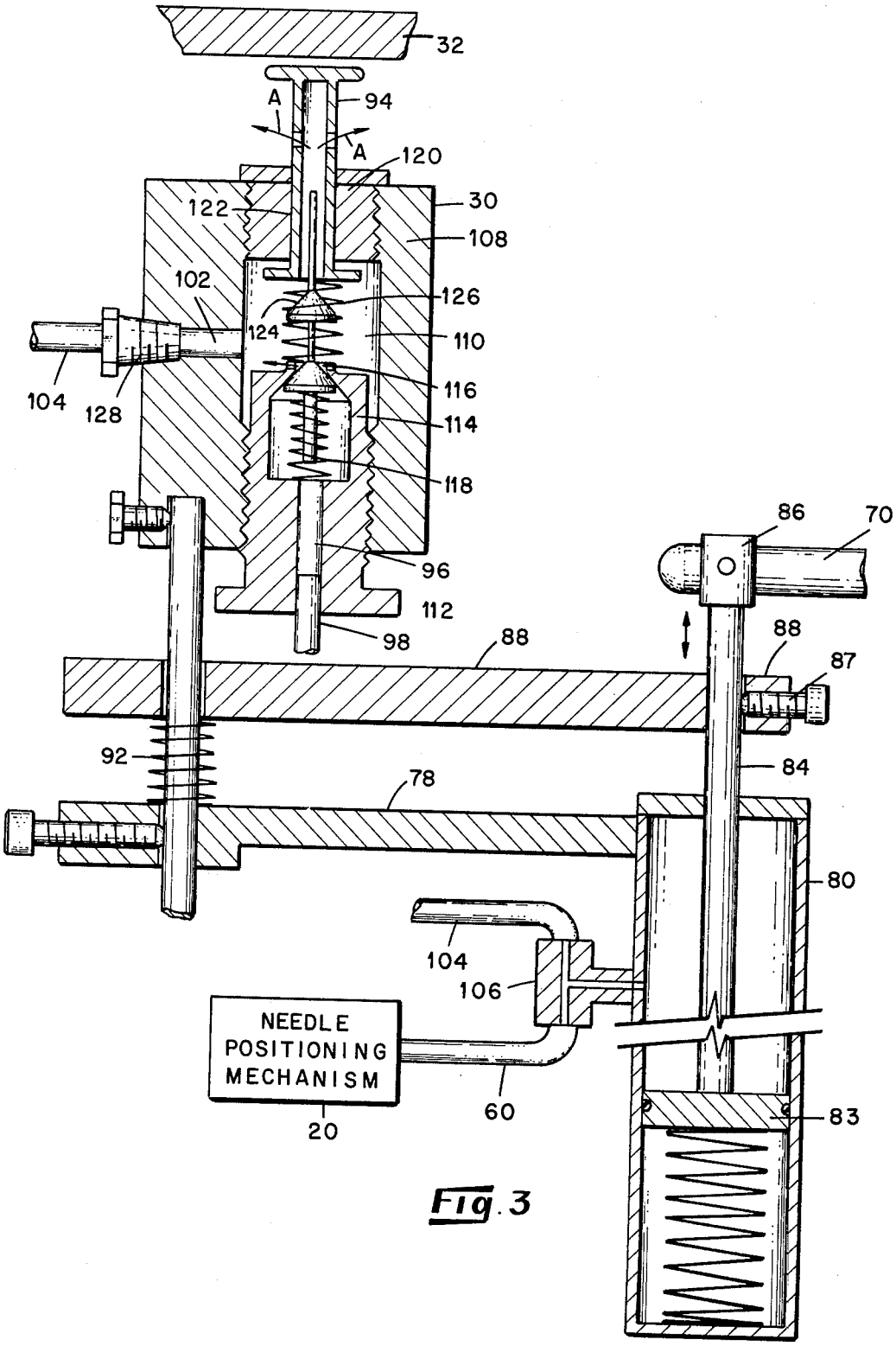
FIG. 3 is a fragmentary, sectional view of one end of a control assembly as disclosed herein.

Still further, to the upper end of the pitman rod 74 there is attached a valve means 30 such as a Model MJV-3 valve available commercially from Clifford Valve Company, Cincinnati, Ohio (See FIGS. 1 and 3). It is to be noted that the valve 30 includes a plunger 94 which serves to open or close the valve 30. The outboard end of this plunger is disposed adjacent the housing 32 of the main drive motor 16 such that movement of the pitman rod 74 up or down selectively depresses the plunger 94 into the valve 30 for purposes which will appear more fully hereinafter. The valve 30 includes an inlet 96 which is connected in fluid communication through a conduit 98 to a source of pressurized air 100. The outlet 102 of the valve 30 is connected by a further conduit 104 to one inlet of a tee fitting 106. One outlet of this tee fitting (see FIG. 3) is connected in fluid communication with the cylinder 80. The remaining outlet of the tee fitting is connected by means of the conduit 60 to the piston-cylinder device 56 of the needle positioning mechanism 20.

Referring now to FIG. 3, the valve 30 comprises a body 108 defining a tee shaped internal bore 110. The inlet 96 of this valve is provided with a fitting 112, within the internal end 114 of which there is received one end of a spool member 116 which sealably engages the interior end 114 of the fitting 112 in response to the urging of a coil spring 118. Accordingly, the valve 30 is normally closed. In FIG. 3, the spool 116 is depicted in a closed position for purposes of illustration. The bore 110 further receives a fitting 120 having an internal bore 122 through which there is slidably received the plunger 94. As depicted, the plunger is hollow to provide a fluid passageway from the atmosphere to the interior of the bore 110 when the plunger is in its extended position. Further, the spool 116 includes a valve closure member 124 which is adapted to engage the inner end of the plunger 94 to close the hollow interior thereof and seal the bore 110 from ambient atmosphere. As noted, the plunger 94 is biased in its extended position by a spring 126 to provide an exhaust passageway to ambient atmosphere. By reason of the physical relationship of the plunger and the spool 116, depression of the plunger into contact with the valve closure member 124 further serves to move the spool out of sealing engagement with the internal end of the fitting 112 and to open the valve 30 for the flow of pressurized air therethrough. Further, the valve includes an outlet 102 which, in the depicted embodiment, is provided with a fitting 128 by means of which the conduit 104 is connected in fluid communication with the bore 110. It is noted that when the plunger 94 is in its extended position, the conduit 104 and all elements downstream thereof, are exhausted to the atmosphere through the hollow plunger 94 as indicated by the arrows A.

In a typical operation employing the disclosed system, at the end of a stitching operation, the operator heels back on the pedal 24. This action, through the pitman rods 72 and 74 and the piston-cylinder device 28, serves to move the leg 70 of the arm 64 upwardly as viewed in FIG. 1, thereby disengaging the clutch mechanism of the main drive motor and applying the brake thereof to stop rotational movement of the motor shaft 40, which in turn, through the pulleys 38 and 34 and the drive belt 36, effects immediate cessation of rotation of the shaft 12 and cessation of the reciprocatory movement of the stitching needle.

Simultaneously, the movement of the pitman rods 72 and 74 moves the valve 30 toward the motor housing 32 such that the plunger 94 engages such motor housing to depress the plunger withing the valve 30. This action opens the valve 30 to permit the flow of pressurized air through the valve 30, through the conduit 104 to the tee fitting 106. The pressurized air flows through the tee fitting 106 into the upper portion of the interior of the cylinder 80 to react against the upper surface of the piston 83 within the cylinder to retract the piston rod 84 within the cylinder 80 and exert a downward movement of the brake arm 64. This movement of the arm 64 is selected to be sufficient only to release the braking mechanism but not so great as to engage the clutch mechanism or reactivate the main drive motor 16. In this relation, it is recalled that the bracket 88 is adjustably secured to the piston rod 84 as by a set screw to afford the required degree of adjustability of the piston-cylinder device 28 relative to the pitman rod 74 and the leg 70 of the arm 64.

Simultaneously with introduction of the pressurized air to the cylinder 80, the pressurized air is introduced to the piston-cylinder device 56 for carrying out of the needle positioning operation as described in U.S. Pat. No. 3,977,339.

To recommence a stitching operation, the operator depresses the foot pedal 24, which, through the pitman rods 72 and 74 and the piston-cylinder 28 exerts a downward pull on the arm 64 to engage the main drive motor with the shaft 40 and thus operate the stitching mechanism. As the foot pedal is so depressed, the valve 30, hence its plunger 94, is moved away from the motor housing 32 so that the plunger moves to its extended position, closing the valve 30 and exhausting the system downstream thereof to deactivate the piston-cylinder device 28 and the needle positioning mechanism 20.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed:

1. A system for positioning the needle of a stitching machine of the high speed type which includes a main drive motor having a brake associated therewith which is actuatable by generally lineal movement of a member thereof, a needle reciprocatory mechanism including shaft means positively connected in driving and stopping relationship to said drive motor, a pneumatically powered needle positioning mechanism connected to said shaft means, a foot pedal, a pitman rod, means connecting one end of said pitman rod to said foot pedal, a piston-cylinder device secured to said pitman rod and with its piston member operatively connected to said brake actuating member, normally closed valve means secured to said pitman rod in a location adjacent a stationary member, said valve means including plunger means projecting therefrom and operable to selectively open said valve means for the flow of pressurized air therethrough or to close said valve, said plunger being disposed adjacent said stationary member whereby movement of said foot pedal to activate said drive motor and commence a stitching operation moves said valve means away from said stationary member and said plunger moves to a position which results in closing of said valve means and whereby movement of said foot pedal to a position for stopping a stitching operation moves said valve toward said stationary member to move said plunger to a position which results in opening of said valve, a source of pressurized air, conduit means connecting said source of pressurized air to said valve means, further conduit means connecting said valve means to said piston-cylinder device and to said needle positioning mechanism for providing an actuating force for each.

2. The system of claim 1 including a further pitman rod, and means releasably connecting said pitman rods one to the other for adjustment of the effective length of said rods.

3. The system of claim 1 wherein said brake actuating mechanism for said main drive motor comprises arm means associated with said drive motor and extending therefrom in cantilevered fashion, said piston member being connected to the outboard end of said arm means.

4. The system of claim 1 wherein the limit of travel of said piston member is selected to release said brake without actuation of said drive motor.

* * * * *